US008151752B2

(12) United States Patent
Hendriksma

(10) Patent No.: US 8,151,752 B2
(45) Date of Patent: Apr. 10, 2012

(54) DEACTIVATING HYDRAULIC LASH ADJUSTER FOR ORIENTED MOUNTING IN AN ENGINE

(75) Inventor: Nick J. Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 520 days.

(21) Appl. No.: 12/322,905

(22) Filed: Feb. 9, 2009

(65) Prior Publication Data

US 2009/0199805 A1 Aug. 13, 2009

Related U.S. Application Data

(60) Provisional application No. 61/065,343, filed on Feb. 11, 2008.

(51) Int. Cl.
*F01L 1/14* (2006.01)

(52) U.S. Cl. ..... 123/90.52; 123/90.48; 123/90.5; 123/90.55; 74/569

(58) Field of Classification Search ..... 123/90.48, 123/90.5, 90.52, 90.55; 74/569
See application file for complete search history.

(56) References Cited

U.S. PATENT DOCUMENTS 7,086,360 B1 * 8/2006 Schnell et al. ..... 123/90.5
2009/0007871 A1 1/2009 Bugescu

* cited by examiner

*Primary Examiner* — Ching Chang
(74) *Attorney, Agent, or Firm* — Thomas N. Twomey

(57) ABSTRACT

A deactivating hydraulic lash adjuster comprising a pin housing slidably disposed in a body and having at least one lock pin disposed in a transverse bore for extending into a receiver feature in the body to lock the two together during periods of engine operation in valve non-deactivation mode. The present improvement consists in providing a first orienting feature for the lash adjuster body that engages a second orienting feature on an engine head to provide a preferred and fixed orientation of the body within a bore in the engine head. In a currently preferred orientation, the axis of the at least one lock pin is parallel to the axis of the engine camshaft. The orientation of the lock pin(s) to the body is made invariant by insertion of a pin through a radial bore in the body into a longitudinal groove in the pin housing.

8 Claims, 5 Drawing Sheets

DEACTIVATING HYDRAULIC LASH ADJUSTER FOR ORIENTED MOUNTING IN AN ENGINE

RELATIONSHIP TO OTHER APPLICATIONS AND PATENTS

This application claims the benefit of U.S. Provisional Application No. 61/065,343, filed Feb. 11, 2008.

TECHNICAL FIELD

The present invention relates to hydraulic lash adjusters (HLAs) in internal combustion engines; more particularly, to such HLAs having means for selectively engaging and disengaging activation of valves in valvetrains; and most particularly, to an improved valve deactivating HLA for oriented, non-rotatable mounting in an engine such that the axis of the lock pins can be made substantially parallel to the axis of the camshaft.

BACKGROUND OF THE INVENTION

It is well known that overall fuel efficiency in a multiple-cylinder internal combustion engine can be increased by selective deactivation of one or more of the engine valves under certain engine load conditions.

For an overhead-cam engine, a known approach is to equip the hydraulic lash adjusters for those valvetrains with means whereby the roller finger followers (RFFs) may be rendered incapable of transferring the cyclic motion of engine cams into reciprocal motion of the associated valves. Such lash adjusters are known in the art as Deactivating Hydraulic Lash Adjusters (DHLAs).

A prior art DHLA includes a conventional hydraulic lash elimination means disposed in a plunger having a domed head for engaging the RFF. The plunger itself is slidably disposed in a pin housing containing the lock pins which in turn is slidably disposed in a DHLA body. The pin housing may be selectively latched and unlatched hydromechanically to the body by the selective engagement of a spring and pressurized engine oil on lock pins.

During engine operation in valve deactivation mode, the lock pins are withdrawn from lock ledges in the body, which may be an annular groove, and the pin housing is reciprocally driven in oscillation by the socket end of the RFF which pivots on its opposite pad end on the immobile valve stem as the cam lobe actuates the RFF. The pin housing is returned during half the lost motion reciprocal cycle by one or more lost motion springs disposed within the body.

In a prior art DHLA, the angular orientation of the DHLA body is not specified with respect to the cylinder head. As a result, the axis of the lock pins is free to assume any random orientation, even for the case when the orientation of the pin housing is fixed relative to the body. This variability in orientation can result in the problem of unequal load sharing for locking mechanisms utilizing two pins, the solution to which is the subject of the present invention.

During valve actuation, the displacement of the RFF by the cam lobe creates cyclically-imposed force vectors on the head of the DHLA plunger. Specifically, as the RFF roller climbs the opening flank of the cam eccentric, the RFF body is urged in a first direction transverse to the axis of the camshaft; and as the RFF roller descends the closing flank of the cam eccentric, the RFF body is urged in a second and opposite direction. Since the orientation of the lock pin axis is not explicitly specified, there are times when the pin axis will assume an orientation co-planar with the cyclic side loads described above. In this situation (wherein the pin axis is perpendicular to the axis of the camshaft), when the side loads reach a sufficient magnitude relative to the axial load, the entire load is entirely supported by only one of the lock pins. When the side load subsequently changes direction, the aforesaid pin is completely unloaded and the other pin assumes the full axial load. Instead of both pins equally sharing the axial load as desired, the lock pins cyclically alternate between supporting the entire load individually and being totally unloaded.

This problem can be relieved by orienting the lock pin axis to be substantially parallel to the axis of the camshaft, thus enabling both lock pins to share the torque load equally. Such orientation can also be used to locate vulnerable points, known in the art as "stress risers", in the DHLA body and pin housing in positions of low tensile stress.

What is needed in the art is an improved arrangement for fixing the orientation of a DHLA body within a bore in an engine head such that the axis of the lock pins in the pin housing is always parallel to the axis of the engine camshaft.

It is a principal object of the present invention to reduce wear in, and extend the operating life of, a deactivating hydraulic lash adjuster in an internal combustion engine.

SUMMARY OF THE INVENTION

Briefly described, an improved deactivating hydraulic lash adjuster in accordance with the present invention comprises a pin housing slidably disposed in a lash adjuster body as in the prior art, and having opposed, spring-loaded pins disposed in a transverse bore in the pin housing for extending into receiver features in the body to lock the two together during periods of engine operation in valve non-deactivation mode.

The present improvement consists in providing a first orienting feature for the DHLA body that engages a second orienting feature on an engine head to provide a preferred orientation of the body within a bore in the engine head. In a currently preferred orientation, the axis of the lock pins is substantially parallel to the axis of the engine camshaft.

This improvement necessitates that the orientation of the pin housing with respect to the body must also be invariant. One known means for achieving this restraint is insertion of a pin or ball through a radial bore in the body into a longitudinal groove in the pin housing.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
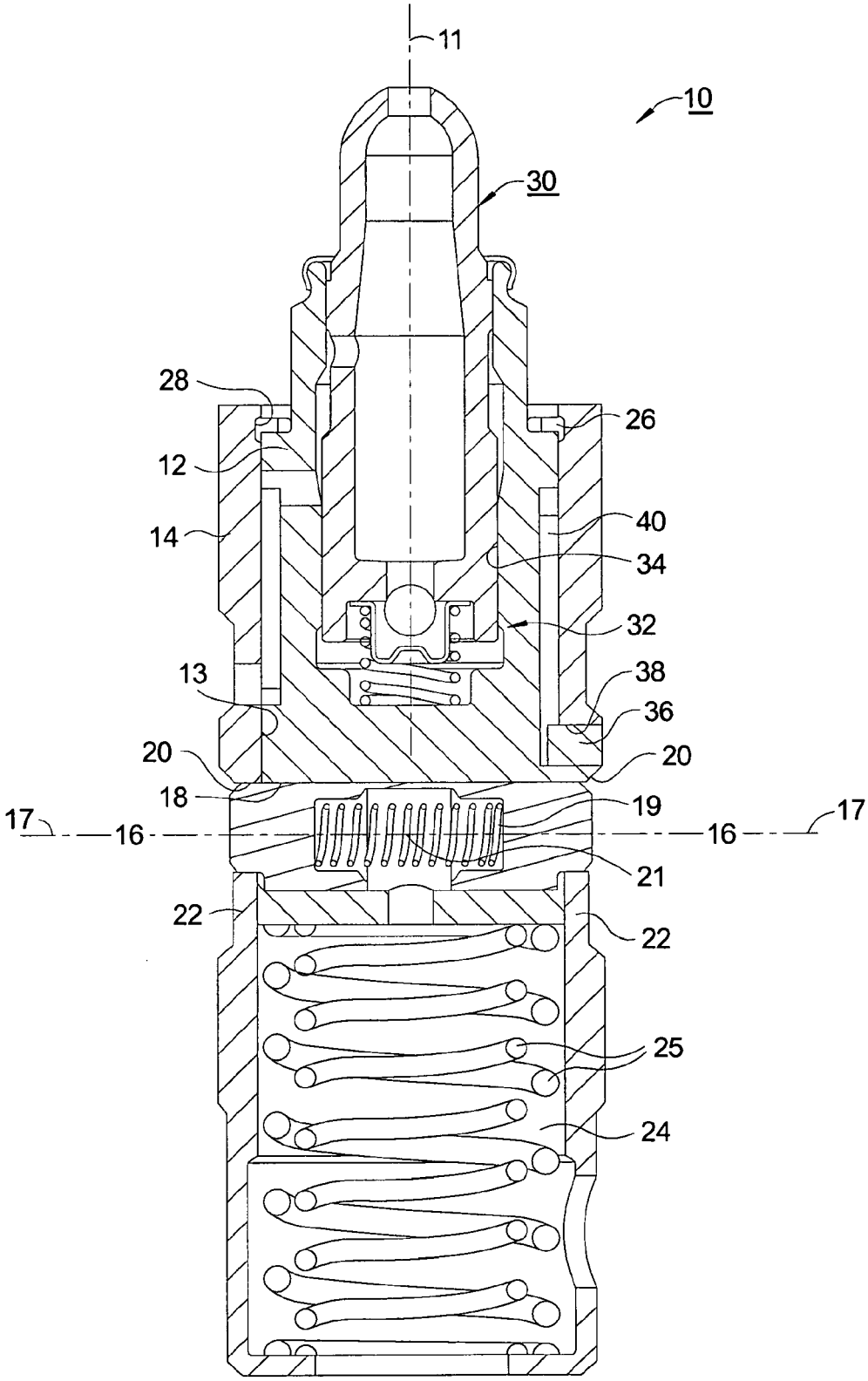
FIG. 1. PRIOR ART
FIG. 1 is an elevational cross-sectional view of a prior art deactivating hydraulic lash adjuster.
Figure 1A:
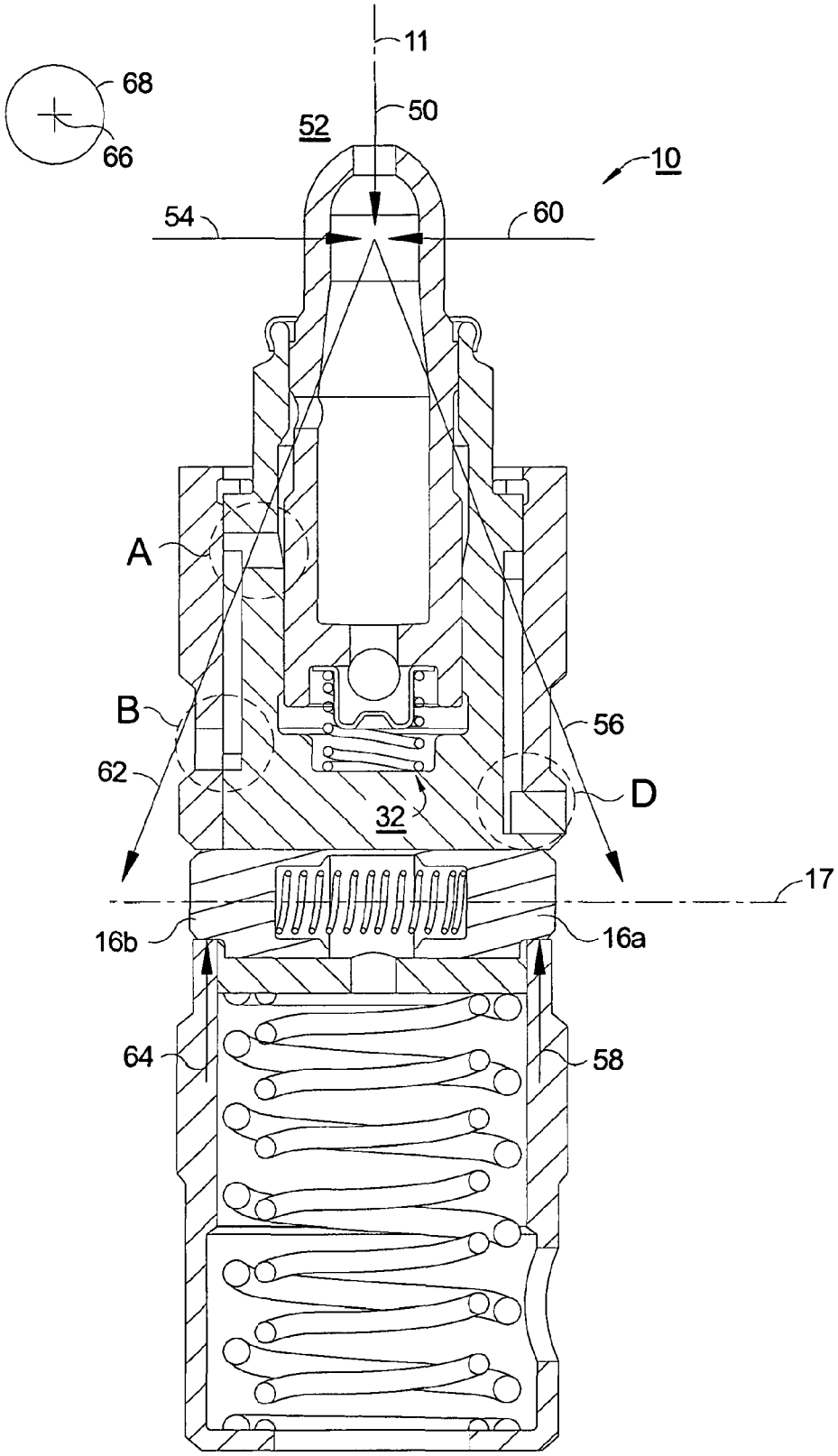
FIG. 1A. PRIOR ART
FIG. 1A is an elevational cross-sectional view like that shown in FIG. 1, showing vectors imposed on a DHLA during opening and closing of an associated engine combustion valve.

Referring to FIGS. 1 and 1A, a prior art deactivating hydraulic lash adjuster (DHLA) 10 comprises a pin housing 12 slidably disposed in a bore 13 in lash adjuster body 14. First and second opposed, spring-loaded pins 16 having an axis 17 are disposed in a transverse bore 18 in pin housing 12 and separated by a spring 19 for extending into mating features in the walls of body 14 to lock the two together during periods of engine operation in valve activation mode (as is shown in FIG. 1). This feature can be, for example, a circumferential ledge formed by an internal annular groove in the body or by means of throughbores 20 extending completely through wall 22 of body 14, providing the full thickness of body wall 22 to engage. A chamber 24 formed in body 14 below pin housing 12 contains one or more lost motion compression springs 25 for absorbing the reciprocating action of the pin housing during valve deactivation, and for urging pin housing 12 against lash clip 26 in groove 28 to permit locking of pins 16 into corresponding feature in body 14. A conventional hollow plunger assembly 30 containing a valvetrain lash adjustment mechanism 32 is slidably disposed in a bore 34 in pin housing 12.

Orientation of pin housing 12 about the axis 11 of DHLA 10 with respect to body 14 must be invariant in order to ensure the lock pin axis is maintained in the desired relationship. A known means for prohibiting rotation of the pin housing within the body is insertion of a stop means such as a pin or ball 36 through a radial bore 38 in body 14 into a longitudinal groove 40 in pin housing 12.

Referring to FIG. 1A, force vectors exerted on DHLA 10 are shown during opening and closing of an associated engine combustion valve when DHLA 10 is in valve activation mode (lock pins 16 extended), and when DHLA 10 is oriented as shown in FIGS. 1 and 1A in the prior art with lock pin axis 17 in a plane orthogonal to the axis 66 of the engine camshaft 68. As the valve begins to open, the RFF climbs the opening flank of the cam lobe (not shown), simultaneously imposing axial load 50 and orthogonal load 54 and creating resultant opening vector 56. Similarly, as the valve begins to close, the RFF descends the closing flank of the cam lobe, imposing axial load 50 and orthogonal load 60 and creating resultant closing vector 62. Axial load 50 is reacted by forces 58 and 64 against pins 16*a* and 16*b*, respectively. However, if vector 56 or 62 does not pass between reactant vectors 58 and 64 then the entire axial load is supported by only one of the lock pins. In FIG. 1A for example, vector 56 lies outside the boundaries defined by vectors 58 and 64 so the entire axial load 50 is supported only by lock pin 16*a*. Conversely, in the case of vector 62 the entire axial load is supported by lock pin 16*b*.

The unequal load sharing described above arises when vectors 56,58 and 62,64 as well as axis 17 are contained in a common plane and is undesirable for causing increased stress and wear on lock pins and their mating features on the body 10. Note further than if axis 17 can be made parallel to camshaft axis 66 by rotation of DHLA 10 90° about its own axis 11, then vectors 56, 58 and 62, 64 are not contained in a common plane with axis 17 and therefore the axial load is shared approximately equally by the lock pins.

Fixing the orientation of the body and the pin housing also enables reduced tensile forces vulnerable areas known as stress risers, shown in FIG. 1A as exemplary regions A, B, and C. These are regions including holes, slots and any such features with potential for sharp edges. Cyclic stress in these stress risers can cause premature fatigue and failure of the components. These feature can be located in the body and pin housing such that when axis 17 is parallel to the camshaft the associated stress risers are positioned in regions of lowest tensile stress.

As noted above, the object of the present invention is to fix the orientation of a DHLA with respect to a bore in an engine head. This may be accomplished by equipping the DHLA with a first feature extending from the DHLA body that engages a second feature on the engine head. The second feature may be a new feature formed in the head specifically to interact with the DHLA feature; or the second feature may be an otherwise occurring feature, for example, a camshaft bearing tower. The latter case is generally preferred since no modification of prior art head design and manufacture is required. The following is a description of examples of both types of non-rotation features in accordance with the present invention.

Referring to FIGS. 2 through 5, a sequence of steps is shown for equipping a DHLA body 14 with a first feature 100 extending laterally from body 14 to engage a prior art second feature that includes a head protuberance 115 otherwise unrelated to said deactivating hydraulic lash adjuster on an engine head and not requiring a new second feature to be formed in the engine head. First feature 100 is shown generically as a square shape because the actual shape is dependent upon the nature and shape of the engine protuberance to be engaged. An exemplary such protuberance is a camshaft bearing tower as is known in the art to be formed on an engine head.

Figure 2:
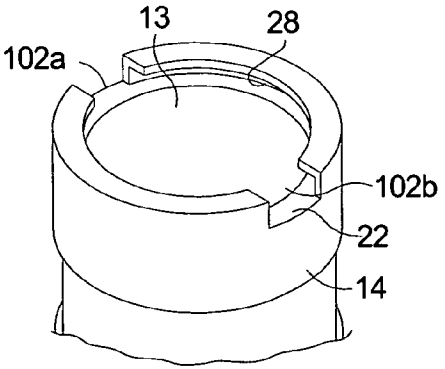
FIGS. 2 through 5 show a sequence of steps in providing a first embodiment of a non-rotation feature for a DHLA body.
Figure 3:
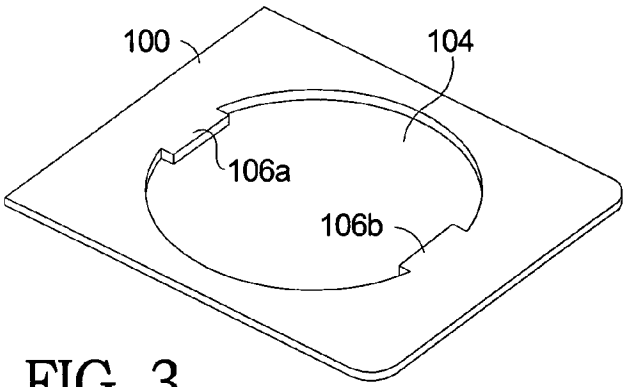
Figure 4:
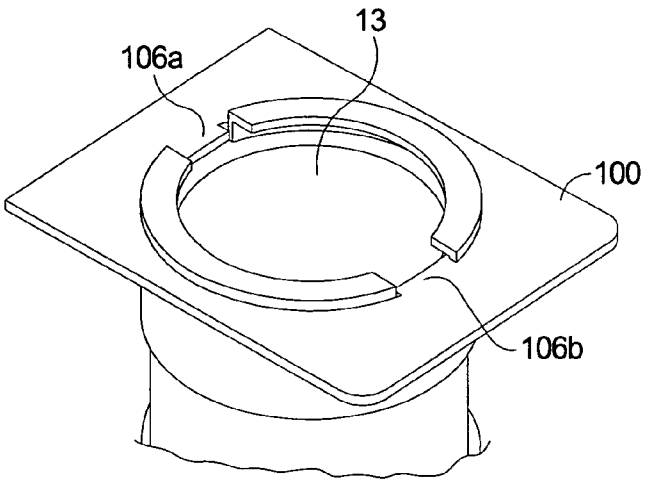
Figure 5:
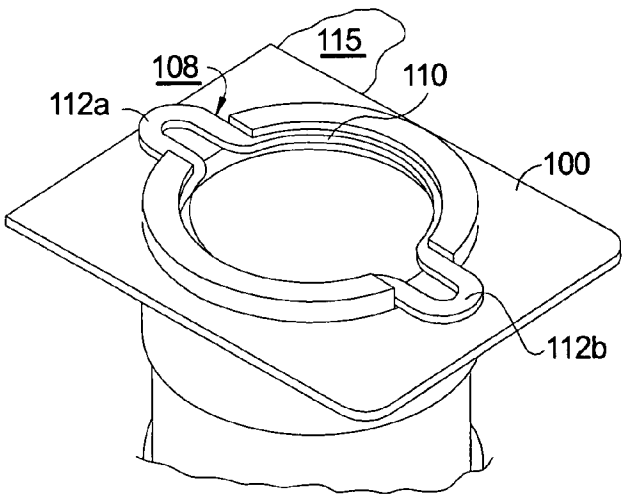
Figure 6:
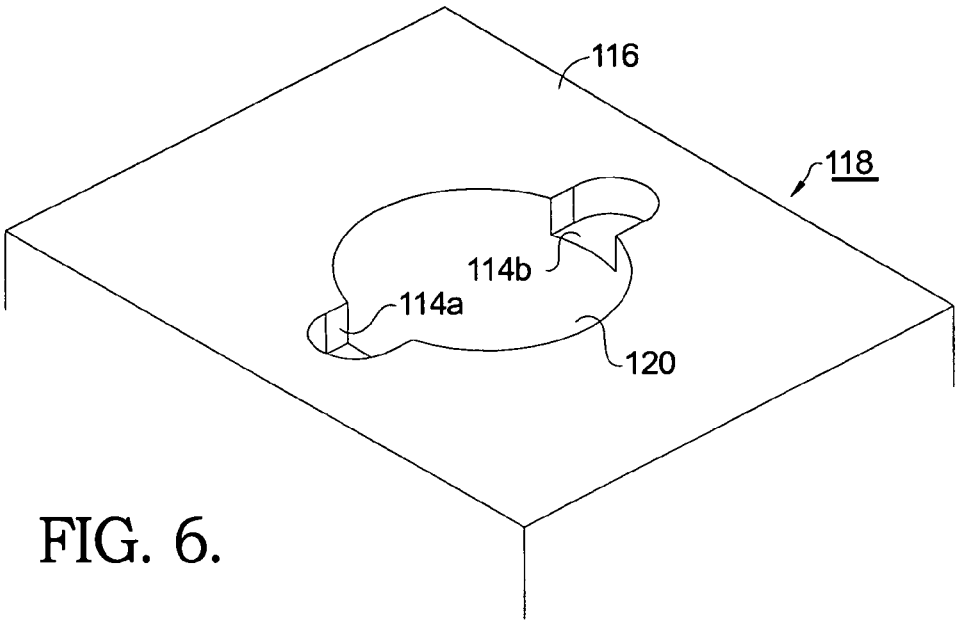
FIG. 6 is an isometric view of a portion of the surface of an engine head wherein a bore is provided for receiving a DHLA in accordance with a second embodiment of the present invention, showing first and second detents formed in the head surface.

Body 14 includes an annular lash ring groove 28, as shown in FIG. 1. First, and preferably second, diametrically opposed cutouts 102*a*,102*b* are formed in body 14, intersecting groove 28 (FIG. 2). Non-rotation feature 100 includes a central opening 104 having a main diameter slightly larger than the main diameter of body 14, and includes first and second tabs 106*a*, 106*b* that extend inwardly of opening 104 (FIG. 3). When feature 100 is mounted onto body 14 (FIG. 4), tabs 106*a*,106*b* extend into cutouts 102*a*,102*b*, respectively, by a distance less than the thickness of wall 22 of body 14 and therefore do not extend beyond bore 13 and cannot make contact with pin housing 12 (FIG. 1). Therefore, feature 100 preferably is not part of the internal mechanical lash stackup of the DHLA. A lash clip 108 includes a ring-shaped portion 110 for insertion into groove 28 (FIG. 5), and first and second tangs 112*a*,112*b* for insertion into cutouts 102*a*,102*b*, respectively. Preferably, the thickness of lash clip 108 is selected to provide the correct internal mechanical lash for the pin housing and lock pins within the body. Thus lash clip 108 functions both to set the lash and to retain non-rotation feature 100 on body 14. Preferably, tangs 112*a*,112*b* are formed having a width slightly larger than the width of cutouts 102*a*,102*b* such that lash clip 108 snaps into and is compressively retained in groove 28. Note that anti-rotation is provided by feature 100 and not by lash clip 108 which does not make contact with the engine head.

Figure 7:
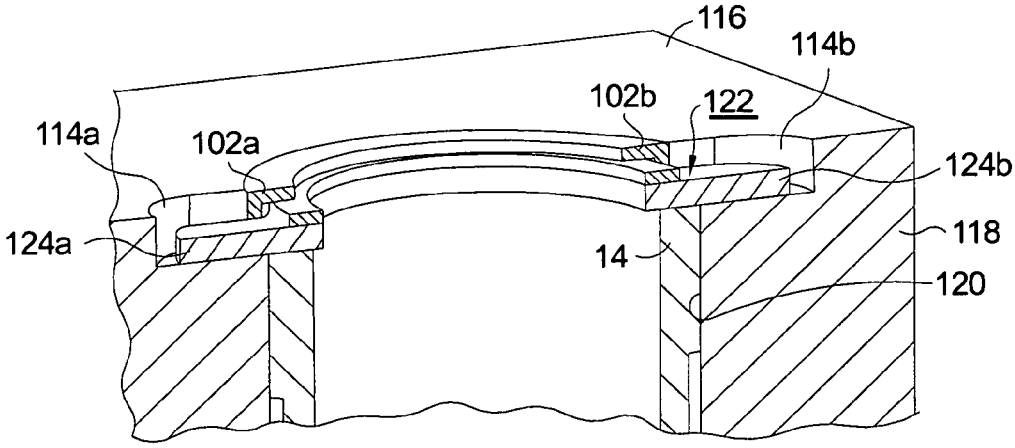
FIG. 7 is an isometric view in partial cutaway showing installation of a DHLA in the bore shown in FIG. 6, with a non-rotation clip and lash ring installed in the first and second detents.
Figure 8:
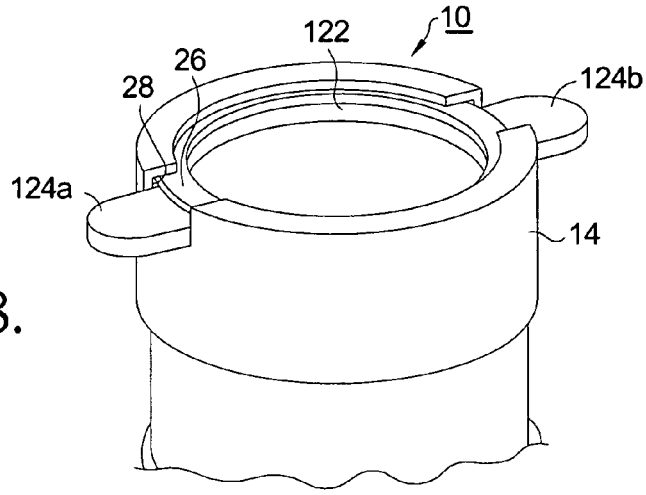
FIG. 8 is an isometric view of an end portion of a DHLA in accordance with the invention, showing the clip and lash ring from FIG. 7 fully installed.

Referring now to FIGS. 6 through 10, a second non-rotation feature comprises exemplary detents 114*a*,114*b* formed in a surface 116 of engine head 118 extending into a bore 120 for receiving a DHLA 10 equipped with a feature for mating with detents 114*a*,114*b*. As shown in FIGS. 7 and 8, body 14 is provided with a groove and cutouts as shown in FIG. 2. A non-rotation clip 122 includes first and second diametrically opposed tangs 124*a*,124*b* that extend beyond body 14 through cutouts 102*a*,102*b*, respectively, when clip 122 is inserted into groove 28. A lash ring 26 of selected thickness is also installed in groove 28 adjacent clip 122; lash ring 26 may be integral with clip 122 if so desired. When DHLA 10 is equipped with clip 122 and lash ring 26 and inserted into bore 120 with tangs 124*a*,124*b* inserted into detents *a*,114*b*, respectively, as shown in FIG. 7, body 14 is prevented from rotation within bore 120.

Since pin housing 12 is constrained from rotation within body 14 (FIG. 1), the proper orientation of tangs 124*a*,124*b* with respect to lock pin axis 17, combined with the proper orientation of detents 14*a*,114*b* with respect to camshaft axis 66 permits the fixed alignment of lock pin axis 17 with camshaft axis 66 in accordance with the object of the present invention.

Figure 9:
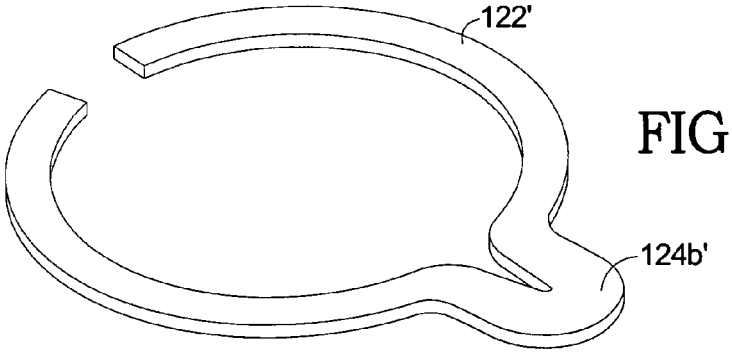
FIG. 9 is an isometric view of an alternative clip.
Figure 10:
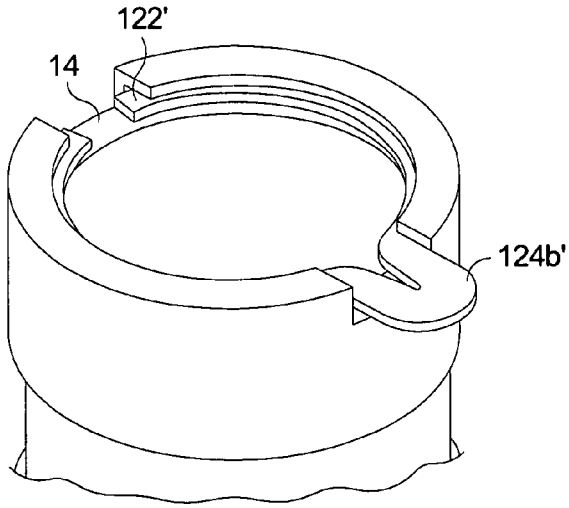
FIG. 10 is an isometric view like that shown in FIG. 8, showing the ring in FIG. 9 installed over a lash ring in the DHLA.

Clip 122 may take any of several forms within the scope of the invention. For example, a spring clip 122' as shown in FIGS. 9 and 10 may have only a single tang 124*b*' and may define a proper-thickness lash clip. It will be seen that only a single tang 122 is necessary to maintain correct orientation of body 14 with respect to bore 120. However, it makes misassembly possible in that the DHLA may be installed when turned erroneously 1800. This potential error may be overcome in a variety of obvious ways, such as by forming only a single head detent 114.

While the DHLA, in accordance with the invention, has been described as a switchable support member used in conjunction with an engine having an overhead-camshaft valvetrain, it is understood that the invention is also applicable to other types of switchable members in a valvetrain having one or more hydromechanically locking pins such as a deactivating valve lifter used in a pushrod engine.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A deactivating hydraulic lash adjuster in a valvetrain in an internal combustion engine wherein said deactivating hydraulic lash adjuster is disposed in a bore in said engine, said deactivating hydraulic lash adjuster comprising a) a body having a first axial bore;

b) a pin housing slidably disposed in said first axial bore having a fixed rotational orientation relative to said body and having a transverse bore through said pin housing;

c) at least one lock pin slidably disposed in said transverse bore; and d) a first feature attached to said body for engaging a second feature formed in said engine for rotationally orienting said body in said engine and for preventing rotation of said body in said engine bore after installation of said deactivating hydraulic lash adjuster into said engine, wherein said second feature includes a protuberance otherwise unrelated to said deactivating hydraulic lash adjuster, and wherein said first feature comprises:

e) a groove formed in said body of said deactivating hydraulic lash adjuster;

f) at least one cutout formed in said body and extending into said groove;

g) a clip disposed in said groove and having at least one tang extending through said at least one cutout beyond the outer surface of said body; and h) a non-rotation feature surrounding said body and extending away from said body for engaging said protuberance to prevent rotation of said body within said engine bore, said non-rotating feature having at least one tab extending inwardly into said at least one cutout.

2. A deactivating hydraulic lash adjuster in accordance with claim 1 further comprising a lash ring disposed within said groove with said non-rotation feature.

3. A deactivating hydraulic lash adjuster in accordance with claim 1 further comprising first and second cutouts and first and second tabs extending inwardly into said first and second cutouts, respectively.

4. A deactivating hydraulic lash adjuster in accordance claim 1 wherein said at least one lock pin includes first and second opposed lock pins.

5. A deactivating hydraulic lash adjuster in accordance with claim 1 further comprising a lost motion spring compressively disposed in a chamber in said body for urging relative motion between said body and said pin housing.

6. A deactivating hydraulic lash adjuster in a valvetrain in an internal combustion engine wherein said deactivating hydraulic lash adjuster is disposed in a bore in said engine, said deactivating hydraulic lash adjuster comprising:

a) a body having a first axial bore;

b) a pin housing slidably disposed in said first axial bore having a fixed rotational orientation relative to said body and having a transverse bore through said pin housing;

c) at least one lock pin slidably disposed in said transverse bore; and d) a first feature attached to said body for engaging a second feature formed in said engine for rotationally orienting said body in said engine and for preventing rotation of said body in said engine bore after installation of said deactivating hydraulic lash adjuster into said engine, wherein said second feature includes at least one detent formed in said engine, and wherein said first feature comprises:

e) a groove formed in said body of said deactivating hydraulic lash adjuster;

f) at least one cutout formed in said body and extending into said groove; and g) a clip disposed in said groove and having at least one tang extending through said at least one cutout beyond the outer surface of said body to engage said at least one detent.

7. A deactivating hydraulic lash adjuster in accordance with claim 6 wherein said second feature includes first and second detents formed in said engine, and wherein said clip comprises first and second tangs disposed in said first and second detents, respectively.

8. An internal combustion engine comprising a deactivating hydraulic lash adjuster for supporting a roller finger follower in a valvetrain in said engine when said deactivating hydraulic lash adjuster is disposed in a bore in said engine, including a body having a first axial bore, a pin housing slidably disposed in said first axial bore and having a transverse bore through said pin housing, at least one lock pin slidably disposed in said transverse bore, and a first feature attached to said body for engaging a second feature formed in said engine for rotationally orienting said body in said engine and for preventing rotation of said body in said engine bore after installation of said deactivating hydraulic lash adjuster into said head, wherein said first feature is so oriented in said engine and said second feature is so oriented with respect to an axis of said at least one lock pin that said lock pin axis is in fixed orientation with respect to an axis of an engine camshaft for operating said valvetrain, and wherein said fixed orientation is such that said lock pin axis is substantially parallel to said camshaft axis.

* * * * *